US006628261B1

(12) United States Patent
Sato et al.

(10) Patent No.: US 6,628,261 B1
(45) Date of Patent: Sep. 30, 2003

(54) LIQUID CRYSTAL DISPLAY PANEL DRIVE CIRCUIT AND LIQUID CRYSTAL DISPLAY APPARATUS HAVING TWO SAMPLE/HOLD CIRCUITS COUPLED TO EACH SIGNAL LINE

(75) Inventors: Hideo Sato, Hitachi (JP); Yoshiro Mikami, Hitachiota (JP); Makoto Tsumura, Hitachi (JP); Genshiro Kawachi, Mobara (JP); Tatsuya Ohkubo, Akashi (JP); Shigeo Shimomura, Mobara (JP); Kenkichi Suzuki, Mobara (JP); Masanao Yamamoto, Mobara (JP)

(73) Assignees: Hitachi, Ltd., Tokyo (JP); Hitachi Device Engineering Co., Ltd., Mobara (JP)

( * ) Notice: Subject to any disclaimer, the term of this patent is extended or adjusted under 35 U.S.C. 154(b) by 0 days.

(21) Appl. No.: 09/502,058

(22) Filed: Feb. 10, 2000

(30) Foreign Application Priority Data

Feb. 10, 1999 (JP) ..... 11-032315

(51) Int. Cl.[7] ..... G09G 3/36
(52) U.S. Cl. ..... 345/99; 345/100; 345/96
(58) Field of Search ..... 345/87–103; 349/39, 349/42; 327/94

(56) References Cited

U.S. PATENT DOCUMENTS

| | | | | |
|---|---|---|---|---|
| 5,266,936 A | | 11/1993 | Saitoh | |
| 5,739,803 A | * | 4/1998 | Neugebauer | 345/98 |
| 5,798,747 A | * | 8/1998 | Moraveji | 345/98 |
| 5,874,934 A | * | 2/1999 | Ito | 345/98 |
| 6,049,321 A | * | 4/2000 | Sasaki | 345/99 |
| 6,154,192 A | * | 11/2000 | Katakura et al. | 345/98 |
| 6,243,066 B1 | * | 6/2001 | Murakami et al. | 345/98 |

* cited by examiner

*Primary Examiner*—Steven Saras
*Assistant Examiner*—Amr Awad
(74) *Attorney, Agent, or Firm*—Antonelli, Terry, Stout & Kraus, LLP

(57) ABSTRACT

A drive circuit for a liquid crystal display apparatus and a large-sized liquid crystal display apparatus integrated with the drive circuit and having a reduced area occupied by the circuits. The drive circuit includes sample/hold circuits for sampling the input voltage at a predetermined timing, comparator circuits for comparing the output of the sample/hold circuits with the voltage of the signal line VD(i), switches for controlling the output voltage of the signal line, a voltage supply circuit constituted as an image signal control circuit for supplying a voltage to the switches, and control circuits for controlling the switches in accordance with the output of the comparator circuits. For the liquid crystal display panel drive circuit configured as described above, the signal line is controlled by the switches, and therefore the area occupied by the drive circuits can be reduced.

4 Claims, 12 Drawing Sheets

LIQUID CRYSTAL DISPLAY PANEL DRIVE CIRCUIT AND LIQUID CRYSTAL DISPLAY APPARATUS HAVING TWO SAMPLE/HOLD CIRCUITS COUPLED TO EACH SIGNAL LINE

BACKGROUND OF THE INVENTION

The present invention relates to a drive circuit for a liquid crystal display apparatus of active matrix type, or more in particular to a liquid crystal display apparatus having a drive circuit formed on the same substrate as an active matrix substrate.

The liquid crystal display apparatus of active matrix type comprises a display unit formed with a transistor at each intersection of a plurality of signal lines and scanning lines arranged orthogonally to each other and a drive circuit unit for controlling the voltages of the signal lines and the scanning lines. The transistors used for the display unit include an amorphous silicon (a-Si) thin-film transistor (TFT), a poly-silicon (p-Si) thin film transistor, and a single-crystal silicon MOS (Metal-Oxide Semiconductor) transistor. The a-Si TFT is formed on a glass substrate, and as a drive circuit thereof, a single-crystal silicon integrated circuit is mounted externally. The p-Si TFT is either a high-temperature p-Si TFT formed on a quartz substrate or a low-temperature p-Si TFT formed on a glass substrate. The drive circuit for the liquid crystal display apparatus using the p-Si TFT is formed on the same substrate as the display unit. The amorphous silicon TFT or the low-temperature p-Si TFT formed on the glass substrate can realize a large size screen, while a quartz substrate or a single-crystal silicon substrate is limited to a screen of small or medium size.

The configuration and the operation of the liquid crystal display apparatus of active matrix type will be described in more detail.

Each of the transistors of the display unit has a gate connected to a scanning line, a drain to a signal line and a source to a display electrode. Another substrate formed with a transparent electrode on one surface thereof is arranged in opposed relation to the display electrode, and the liquid crystal is held between the display electrode and the opposed substrate. Normally, the display electrode is connected with a holding capacitor, and therefore the holding capacitor and a liquid crystal capacitor are connected in parallel to the source electrode. When the gate electrode enters a select mode, the transistor turns on, and writes the video signal from the signal line into the liquid crystal capacitor and the holding capacitor. When the gate electrode turns to a non-select mode, on the other hand, the transistor comes to assume a high impedance, and holds the video signal written in the liquid crystal.

The drive circuit unit includes a scanning circuit for controlling the voltage on the scanning line and a signal circuit for controlling the voltage on the signal line. The scanning circuit applies a scan pulse once per frame time to each scanning line. Normally, this pulse timing is differentiated sequentially downward of the panel. One frame time of 1/60 second is often used. A panel having a typical pixel array of 1024×768 dots is scanned 768 times per frame time, and therefore the time width of the scan pulse is about 20 $\mu$s. This scanning circuit is normally configured with a shift register which has an operating speed of about 50 kHz.

On the other hand, the signal circuit supplies each signal line with a liquid crystal drive voltage corresponding to the pixels for one line applied with the scan pulse. In the selected pixels applied with the scan pulse, the voltage of the gate electrode of the transistor connected to the scanning line increases and turns on the transistor. In the process, the liquid crystal drive voltage is applied to the liquid crystal through the drain and the source of the transistor from the signal line, thereby charging the pixel capacitor including the liquid crystal capacitor and the holding capacitor. By repeating this process of operation, a voltage corresponding to the repetitive video signal is applied to the pixel capacitors over the whole surface of the panel for each frame time.

In the case of analog system, the signal circuit for driving the signal line is configured with a shift register and a sample/hold circuit. The shift register generates a timing for the sample/hold circuit corresponding to each pixel. In the sample/hold circuit, the video signal corresponding to each pixel is sampled at this timing, and the liquid crystal drive voltage is supplied to each signal line. This driving method can be realized with a simple circuit configuration including a shift register for generating a timing and a sample/hold circuit for sampling the video signal. This driving method, therefore, is used primarily for a liquid crystal display panel integrated with a drive circuit.

In the aforementioned pixel configuration, the shift register of the signal circuit generates 1024 timing pulses with a time width of the scan pulse of the scanning circuit. As a result, the time interval of the timings of the shift register is not more than 20 ns, and therefore this shift register requires an operating speed of not less than 50 MHz. The sample/hold circuit is required to sample the video signal with this short timing. In the liquid crystal display apparatus integrated with the drive circuit, the sampling time is lengthened by dividing the video signal into a plurality of portions and inputting them in parallel. For this purpose, a signal conversion circuit is required in which a high-speed video signal is split into a plurality of video signals by sampling and the signals thus split are amplified and converted into an alternating current.

In the digital system, on the other hand, the signal circuit for driving the signal lines includes a shift register, a two-stage latch circuit, and a digital-to-analog converter (hereinafter referred to as D/A converter). The video signals sequentially input in digital form are stored in the latch circuit corresponding to each signal line by the shift register and the two-stage latch circuit. The D/A converter converts this data into an analog voltage and thus supplies the liquid crystal drive voltage to each signal line.

The number of bits for the latch circuit and the D/A converter of this system is determined by the gradation to be displayed, and is 8 in the case where 256 tones of each color is required for full-color display. In the pixel configuration described above, a latch circuit of 16384 bits (8 bits×2×1024) and 1024 8-bit D/A converters are required. In the D/A converter for each signal line, the reference voltage is selected by switch in order to reduce variations. In this digital system, the video signal is a digital signal, and therefore the S/N (signal-to-noise) ratio can be prevented from deteriorating at the time of signal transmission.

In both the analog system and the digital system described above, the signal line is required to be driven with an accurate voltage for displaying a high-quality image. The signal line is a capacitive load, the capacitance of which is determined by the capacitance between the drain and gate of the transistor making up the display unit, the crossing capacitance between the signal line and the scanning line and the capacitance between the signal line and the transparent electrode of the opposed substrate. The capacitance of the capacitive load of the signal line, therefore, increases with the size of the display unit and the number of pixels making it up. In the a-Si TFT capable of realizing a large-sized display apparatus, therefore, a buffer amplifier for driving the capacitive load of the signal line is used as an external drive circuit configured with an integrated circuit. With this drive technique using the buffer amplifier, the offset voltage is required to be reduced with the capacitance drivability. This can be achieved by either a method using a differential amplifier circuit or a method using a source-follower amplifier circuit.

A method using a differential amplifier circuit is described, for example, in JP-A-5-297830. This method is an application to a signal line drive circuit of analog type and performs the function of a sample/hold circuit at the same time. This signal line drive circuit includes a differential amplifier circuit, and a capacitor and a switch for holding the voltage and offset correction. The offset voltage of the differential amplifier circuit is corrected by holding the offset voltage in a capacitor.

A method using a source-follower amplifier circuit, on the other hand, is described in U.S. Pat. No. 5,266,936, for example. This is used for a digital signal line drive circuit, and is arranged at the output of a D/A converter for each signal line. This circuit includes a source-follower circuit, a voltage holding circuit, a comparator circuit and a ramp voltage circuit. The source-follower circuit is driven by the ramp voltage circuit through the voltage holding circuit, and the voltage holding circuit is rendered in a hold condition by assuring that the output voltage of the source-follower circuit is coincident with the input voltage of the comparator circuit.

SUMMARY OF THE INVENTION

A drive circuit for an a-Si TFT which can realize a large-sized display apparatus is a single-crystal Si integrated circuit provided externally. Under the circumstance, this drive circuit is provided for each set of about 300 signal lines in order to keep the occupied area of the integrated circuit in a practical range. In similar fashion, for a low-temperature p-Si TFT capable of realizing a large-sized display apparatus, the drive circuits of all the signal lines for display are required to be formed on the same substrate. The number of signal lines is 1024 in the aforementioned case. Three times as many signal lines, i.e. 3072 signal lines are required for color display.

As described above, in the liquid crystal display apparatus integrated with a drive circuit, the signal lines about ten times as many as those driven by the conventional single-crystal Si integrated circuit are required. In the prior art, therefore, the area occupied by circuits on the substrate is increased for the signal line drive circuit. This makes it difficult to use the drive circuit for the liquid crystal drive unit integrated with a drive circuit.

An object of the present invention is to provide a liquid crystal display apparatus capable of reducing the area occupied by the drive circuit in the circuits of the liquid crystal display apparatus integrated with the drive circuit.

Another object of the invention is to provide a large-sized liquid crystal display apparatus integrated with a drive circuit.

The technical measures for achieving the objects described above will be explained below.

According to a first aspect of the invention, there is provided a drive circuit for a liquid crystal display panel comprising sample/hold circuits sampling an input voltage at a predetermined timing, comparator circuits comparing the output of the sample/hold circuit with the voltage on a signal line, switches controlling the output voltage of the signal line, voltage supply means for supplying a voltage to the switch, and control circuits controlling the switch by the output of the comparator circuits.

According to a second aspect of the invention, there is provided a liquid crystal display panel drive circuit adapted to assume a positive status in which the input voltage changes in the same polarity as the video signal and a negative status in which the input voltage changes in the opposite polarity to the video signal, the drive circuit comprising a first drive circuit operated by a positive input voltage and a second drive circuit operated by a negative input voltage.

According to a third aspect of the invention, there is provided a liquid crystal display panel drive circuit of the second aspect, in which the first drive circuit includes a N-type transistor as a switch, and the second drive circuit includes a P-type transistor as a switch.

According to a fourth aspect of the invention, there is provided a liquid crystal display panel drive circuit of the second aspect, in which the operation of the drive circuit is divided into a sampling period when the input voltage is sampled and an output drive period when the voltage on the signal line is driven, the first drive circuit having a sampling period and an output drive period different from the second drive circuit.

According to a fifth aspect of the invention, there is provided a liquid crystal display panel drive circuit of the first or second aspect, in which a logic circuit of inverter type is used as the sample/hold circuit and the comparator circuit.

According to a sixth aspect of the invention, there is provided a liquid crystal display panel drive circuit of the second aspect, in which a positive ramp voltage is used for the voltage supply means of the first drive circuit, and a negative ramp voltage is used for the voltage supply means of the second drive circuit.

According to a seventh aspect of the invention, there is provided a liquid crystal display panel drive circuit of the second aspect, in which a positive fixed power supply is used as the voltage supply means for the first drive circuit, a negative fixed power supply is used as the voltage supply means for the second drive circuit, and the switch is adapted to control the current of the constant current source connected to the fixed power supply.

According to an eighth aspect of the invention, there is provided a liquid crystal display apparatus comprising:

- a first substrate formed with a switching element at each intersection between the scanning lines and the signal lines, a scanning circuit for controlling the voltage of the scanning line, and a signal circuit for controlling the voltage on the signal line;
- a second substrate having a transparent electrode formed on one side thereof;
- a liquid crystal held between the first substrate and the second substrate; and
- a set of drive circuits each having a signal circuit including a sample/hold circuit for sampling the input voltage constituting a video signal at a predetermined timing, a comparator circuit for comparing the output of the sample/hold circuit with the signal line voltage, a switch for controlling the output voltage of the signal line, a voltage supply means for supplying a voltage to the switch, and a control circuit for controlling the switch by the output of the comparator circuit.

According to a ninth aspect of the invention, there is provided a liquid crystal display apparatus of the eighth aspect, wherein the drive circuit includes a first drive circuit turned on by a positive input voltage and a second drive circuit turned on by a negative input voltage.

According to a tenth aspect of the invention, there is provided a liquid crystal display apparatus comprising:

a first substrate on which there are formed at least a switching element at intersections between the scanning lines and the signal lines, at least a scanning circuit for controlling the voltage on the signal line, and a signal circuit for controlling the voltage on the signal line;

a second substrate having a transparent electrode formed on one side thereof;

a liquid crystal held between the first substrate and the second substrate; and a signal circuit including drive circuits, each drive circuit comprising a D/A converter for converting a digital video signal input thereto into an analog voltage, at least a sample/hold circuit for sampling the analog voltage at a predetermined timing, at least a comparator circuit for comparing the output of the sample/hold circuit with the voltage on the signal line, at least a switch for controlling the output voltage of the signal line, at least a voltage supply means for supplying a voltage to the switch, and at least a control circuit for controlling the switch by the output of the comparator circuit.

According to an eleventh aspect of the invention, there is provided a liquid crystal display apparatus comprising:

a first substrate on which there are formed a switching element at each intersection between the scanning lines and the signal lines, a scanning circuit for controlling the voltage on the scanning line, and a signal circuit for controlling the voltage on the signal line;

a second substrate having a transparent electrode formed on one side thereof;

a liquid crystal held between the first substrate and the second substrate;

a first D/A converter for converting a digital video signal input thereto into a positive analog voltage;

a second D/A converter for converting a digital video signal input thereto into a negative analog voltage;

a first drive circuit supplied with a positive analog voltage for sampling the positive analog voltage at a predetermined timing and driving the signal line; and a second drive circuit supplied with a negative analog voltage for sampling the negative analog signal at a predetermined timing and driving the signal line.

According to a twelfth aspect of the invention, there is provided a liquid crystal display apparatus of the eleventh aspect, wherein:

the first drive circuit includes a first sample/hold circuit for sampling a positive analog voltage, a first comparator circuit for comparing the output of the first sample/hold circuit with the voltage of the signal line, a first switch for controlling the output voltage of the signal line, first voltage supply means for supplying a voltage to the first switch, and a first control circuit for controlling the first switch by the output of the first comparator circuit; and the second drive circuit includes a second sample/hold circuit for sampling a negative analog voltage, a second comparator circuit for comparing the output of the second sample/hold circuit with the voltage of the signal line, a second switch for controlling the output voltage of the signal line, second voltage supply means for supplying a voltage to the second switch, and a second control circuit for controlling the second switch by the output of the second comparator circuit.

According to a thirteenth aspect of the invention, there is provided a liquid crystal display apparatus, comprising:

a first substrate on which there are formed at least a switching element at each intersection between the scanning lines and the signal lines, at least a scanning circuit for controlling the voltage on the scanning line, and a signal circuit for controlling the voltage on the signal line;

a second substrate having a transparent electrode formed on one side thereof;

a liquid crystal held between the first substrate and the second substrate;

first and second latch circuits for holding continuous digital video signals;

switching means for switching the outputs of the first and second latch circuits to each other;

a first D/A converter connected to one of the outputs of the switching means for converting a digital video signal into a positive analog voltage;

a second D/A converter connected to the other output of the switching means for converting a digital video signal into a negative analog voltage;

first and second analog signal bus lines connected to the first and second D/A converters, respectively; and first and second output means connected to the first and second bus lines, respectively, for driving the first and second signal lines, respectively;

wherein the first and second output means each include a first drive circuit connected to the first bus line for controlling the positive voltage and a second drive circuit connected to the second bus line for controlling the negative voltage;

wherein a first operation is performed in such a manner that the output of the first latch circuit is applied through the first D/A converter to the first drive circuit constituting the first output means thereby to drive the first signal line while the output of the second latch circuit is applied through the second D/A converter to the second drive circuit constituting the second output means thereby to drive the second signal line, and a second operation is performed in such a manner that the output of the first latch circuit is applied through the second D/A converter to the second drive circuit constituting the first output means to drive the first signal line while the output of the second latch circuit is applied through the first D/A converter to the first drive circuit constituting the second output means thereby to drive the second signal line.

Other objects, features and advantages of the present invention will become apparent from the following description of the embodiments of the invention taken in conjunction with the accompanying drawings.

DESCRIPTION OF THE EMBODIMENTS

Now, embodiments of the invention will be described in detail below with reference to the accompanying drawings.

Figure 1:
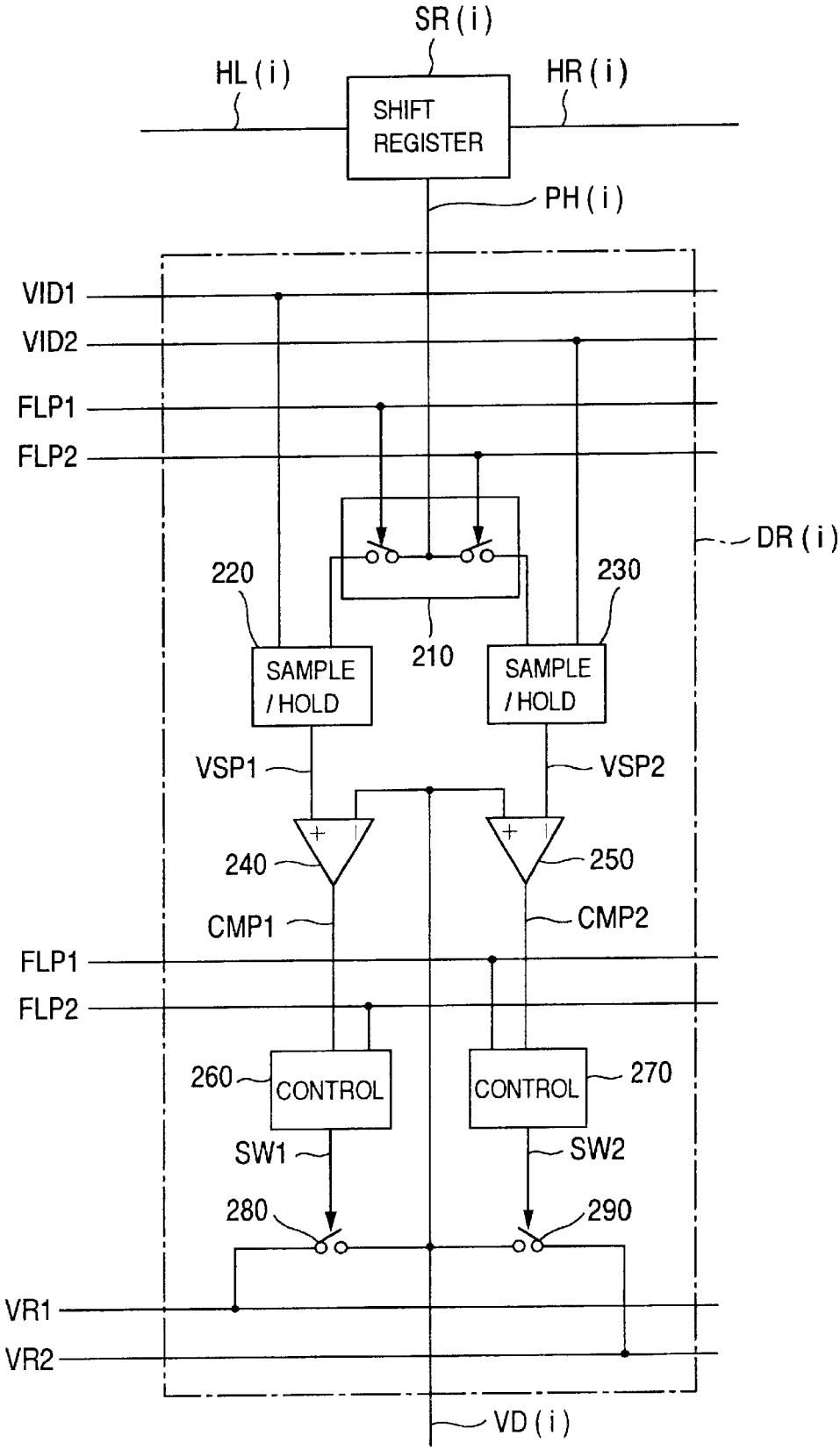
FIG. 1 is a block diagram showing a configuration of a liquid crystal display panel drive circuit according to a first embodiment of this invention.

FIG. 1 is a block diagram showing a configuration of a liquid crystal display panel drive circuit according to a first embodiment of the invention. This embodiment represents a drive circuit for the i-th (i: positive integer) signal line VD(i) and includes a shift register SR(i) and a drive circuit DR(i). The drive circuit DR(i) is configured with a switching circuit 210, sample/hold circuits 220, 230, comparator circuits 240, 250, control circuits 260, 270, and switches 280, 290, and supplied with video signals VID1, VID2, a polarity control signal FLP and output control power supplies VR1, VR2.

The operation of this embodiment having the configuration described above will be briefly explained.

The shift register SR(i) is supplied with a signal HL(i) or HR(i) depending on the scanning direction and outputs a sample signal PH(i). The switching circuit 210 outputs the sample signal PH(i) to the sample/hold circuit 220 or 230 by a polarity control signal FLP1 or an inverted version FLP2 of the signal FLP1. The sample/hold circuits 220, 230 sample the video signals VID1, VID2, respectively, at the timing of the sample signals and output the sampled signals VSP1, VSP2, respectively. The comparator circuits 240, 250 are supplied with the signals VSP1, VSP2 and the signal of the signal line DR(i) and output comparison signals CMP1, CMP2 (VSP1, VSP2), respectively. The control circuits 260, 270 are supplied with the signals VSP1, VSP2, the polarity control signal FLP1 and the inverted version FLP2 of the polarity control signal FLP1 and output switch control signals SW1, SW2, respectively. The switches 280, 290 are supplied with the switch control signals SW1, SW2 for controlling the signal line VD(i). As a result of this operation, the voltage of the signal line VD(i) can be controlled to a voltage equal to the output signal VSP1 or VSP2 of the sample/hold circuits 220, 230.

Figure 2:
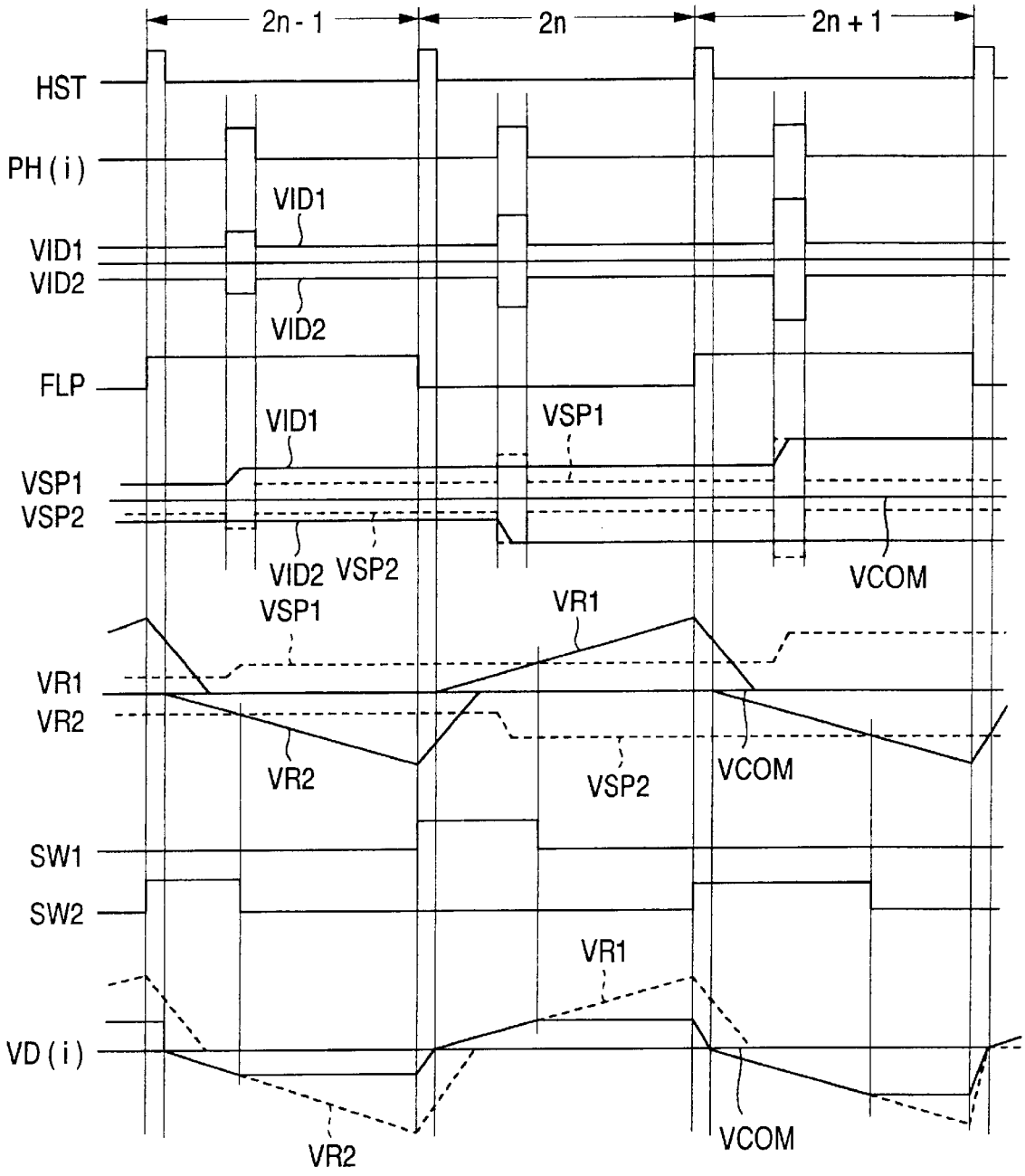
FIG. 2 is a timing chart showing the operation of the liquid crystal panel drive circuit according to this invention.

FIG. 2 is a timing chart showing the operation of the first embodiment.

With reference to the operation timing chart of FIG. 2, the operation of this embodiment will be described in more detail.

A start signal HST is a signal for driving the shift registers of the signal circuit, and represents a start timing of each line of an image to be displayed. In this case, the timing is indicated in the range of 2n−1 to 2n+1 (n: integer). The output PH(i) of the i-th-stage shift register SR(i) is repeated at a timing delayed by the time corresponding to i stages from the start signal HST. The video signals VID1, VID2 are signals corresponding to the image of each line. The video signal VDI1 is positive with respect to the voltage VCOM applied to the opposite electrode, and the video signal VDI2 is negative with respect to VCOM. In the case under consideration, the voltage on the i-th signal line is higher than the voltage on other signal lines and increases with the line number. In the liquid crystal display mode in which white is displayed when the applied voltage is zero, this video signal corresponds to the black vertical line reduced in brightness progressively with the number of lines. The polarity control signal FLP1 is a signal inverted for each start signal HST. In this case, it is "H" for odd-number lines (2n−1) and "L" for even-number lines (2n).

The switching circuit 210 is supplied with the polarity control signal FLP2 and an inverted version FLP2 thereof and outputs the output HR(i) of, the shift register to the sample/hold circuit 220 or 230. The sample/hold circuits 220, 230 sample the video signals VID1, VID2 with the output HR(i) of the shift register passed through the switching circuit 210. As a result, the output VSP1 of the sample/hold circuit 220 comes to assume a waveform sampled at the timing of the output HR(i) from the positive video signal VID1 for even lines, and at the timing of the output HR(i) from the negative video signal VID2 for odd lines. The output control power supplies VR1, VR2 are ramp voltages increasing or decreasing with time based on the VCOM as shown. These voltages VR1 and VR2 correspond to odd and even lines, respectively, and change alternately with each other.

The control circuits 260, 270 are operated by the polarity control signal FLP1 and the inverted version FLP2 thereof. In a state corresponding to an odd line where the polarity signal FLP1 is "H", the control circuit 270 is selected, while in a state where corresponding to an even line where the polarity signal FLP2 is "L", the control signal 260 is selected. As a result, the switch control signal SW2 assumes a "H" state when the signal line output VD(i) is higher than the output VSP2 on an odd line and a "L" state when the signal line output VD(i) is lower than the output VSP1 on an even line. The switches 280, 290 turn on when the switch control signals SW1, SW2 are "H", respectively, thereby to change the output VD(i) with the control voltages VR1 or VR2, and turn off when the switch control signals SW1, SW2 are "L" thereby to hold the output VD(i).

As described above, according to this embodiment, the signal line output VD(i) is changed by the control power supply VR1 or VR2 connected with the switch 280 or 290.

This output VD(i) is compared with the sampled voltage VSP1 or VSP2, and stops being changed when it becomes equal to the sampled voltage VSP1 or VSP2. As a result, the signal line output voltage VD(i) becomes equal to the voltage VSP1 or VSP2. In this way, according to this embodiment, the signal line is controlled by the switch. The restriction to the on resistance of the switches is small since an error is small in view of the fact that the signal line voltage VD(i), even when delayed behind the ramp voltage of the control power VR1 or VR2, can be made equal to the voltage VSP1 or VSP2. At least several tens of percent for the scanning period of each line is sufficiently allowable as the CR time constant due to the on-state resistance of the switches and the load capacitance of the signal line. Assuming that the scanning period per line is 20 $\mu$s, the allowable percentage is 20% and the load capacitance of the signal line is 100 pF, for example, the on-state resistance of 40 kΩ is required for the switches. This value can be realized with a sufficiently small size of various transistors such as the low-temperature p-Si TFT used for the apparatus integrated with a drive circuit.

According to the first embodiment of the invention configured as described above, the area occupied by the output transistors can be reduced.

Further, according to the first embodiment of the invention, the output of the negative video signal is controlled by sampling the positive video signal for odd lines, while the output of the positive video signal is controlled by sampling the negative video signal for even lines. By sampling and controlling the output voltage alternately in this way, the drive time of the signal line can be lengthened, thereby reducing the area occupied by the switches for controlling the signal line.

Figure 3:
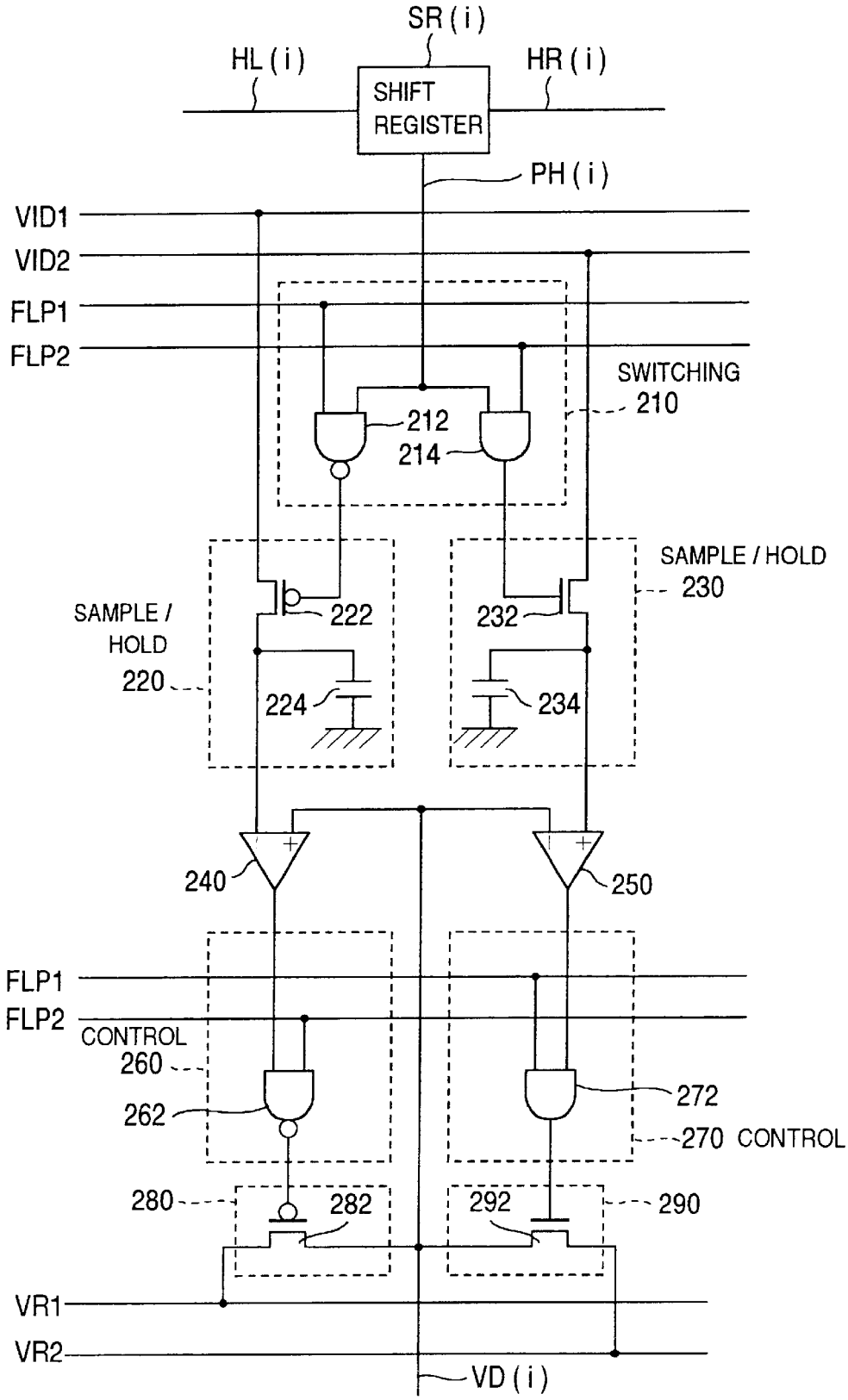
FIG. 3 is a diagram showing a circuit configuration of the liquid crystal panel drive circuit according to a second embodiment of this invention.

A drive circuit used for a liquid crystal display panel according to a second embodiment of the invention is shown in FIG. 3. Those component parts equivalent to those of the first embodiment are designated by the same reference numerals, respectively.

According to this embodiment, as compared with the first embodiment, the switching circuit 210, the sample/hold circuits 220, 230, the control circuits 260, 270 and the switches 280, 290 are different from the corresponding parts, respectively, of the first embodiment.

The switching circuit 210 is configured with a NAND gate 212 and an AND gate 214. The sample/hold circuit 220 is configured with a P-type TFT 222 and a capacitor 224, while the sample/hold circuit 230 is configured with a N-type TFT 232 and a capacitor 234. The control circuits 260, 270 are configured with a NAND gate and an AND gate, respectively. The switches 280, 290 are configured with a P-type TFT 282 and a N-type TFT 292, respectively.

The NAND gate 212 of the switching circuit 210 is supplied with the output PH(i) of the i-th-stage shift register SR(i) and the polarity control signal FLP1 to control the P-type TFT 222 of the sample/hold circuit 220. The AND gate 214, on the other hand, is supplied with the output PH(i) and the inverted version FPL2 of the polarity control signal thereby to control the N-type TFT 232 of the sample/hold circuit 230. With this configuration, when the polarity control signal FLP1 is "H", the output PH(i) is inverted to control the gate electrode of the P-type TFT 222, and the video signal VID1 is sampled in the capacitor 224. When the polarity control signal FLP1 is "L" and the inverted version thereof is "H", that is, the polarity control signal FLP2 is "H", on the other hand, the output PH(i) is applied to control the gate electrode of the N-type TFT 232, thereby sampling the video signal VID2 in the capacitor 234.

The NAND gate 262 of the control circuit 260, which is supplied with the output of the comparator circuit 240 and the inverted version FLP2 of the polarity control signal, controls the P-type TFT of the switch 280 with the inverted signal of the comparator circuit 240. The AND gate 272 of the control circuit 270, which is supplied with the output of the comparator circuit 250 and the polarity control signal FLP1, controls the N-type TFT of the switch 290 with the inverted signal of the comparator circuit 250. With this configuration, the P-type TFT turns on when the inverted version FLP2 of the polarity control signal is "H" and the output of the comparator circuit 240 is "H", while the N-type TFT turns on when the polarity control signal FLP1 is "H", and the output of the comparator circuit 250 is "H".

As the result of this operation, when the inverted version FLP2 of the polarity control signal is "H" and the voltage of the sample/hold circuit 220 is lower than the voltage VD(i) of the signal line, the P-type TFT turns on and the signal line voltage VD(i) is driven by the control power supply VR1, while when the voltage of the sample/hold circuit 220 is higher than the voltage VD(i), the P-type TFT turns off thereby to hold the signal line voltage VD(i).

When the polarity control signal FLP1 is "H" and the voltage of the sample/hold circuit 230 is higher than the signal line voltage VD(i), the N-type TFT turns on thereby the drive the signal line voltage VD(i) with the voltage of the control power supply VR2. When the voltage of the sample/hold circuit 230 is lower than VD(i), on the other hand, the N-type TFT turns off thereby to hold the signal line voltage VD(i).

The second embodiment of the invention having the configuration mentioned above has a similar effect to the first embodiment.

Further, in the configuration of the second embodiment, the sample/hold circuit 220 for controlling the positive video signal and the switch 280 for controlling the output voltage of the positive video signal are configured with a single conductor of the P-type TFT. Also, the sample/hold circuit 230 for controlling the negative video signal and the switch 290 for controlling the output voltage of the negative video signal are configured of a single conductor of the N-type TFT. By configuring each switch with a single conductor as described above, the number of elements of the drive circuit can be reduced thereby to reduce the area occupied by the drive circuit.

Figure 4:
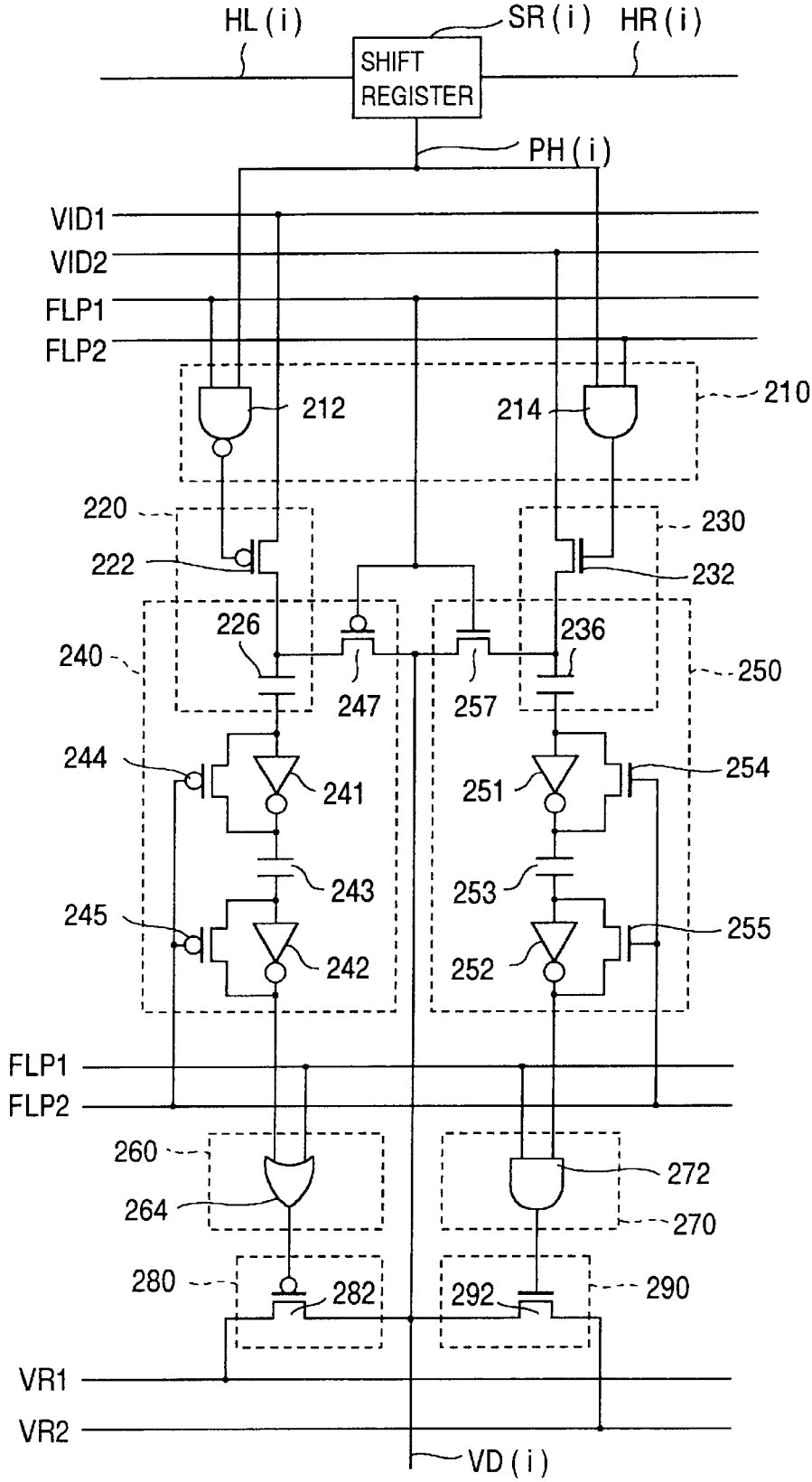
FIG. 4 is a diagram showing a circuit configuration of the liquid crystal panel drive circuit according to a third embodiment of this invention.

FIG. 4 show a drive circuit used for a liquid crystal display panel according to a third embodiment of the invention. The component parts similar to those of the second embodiment shown in FIG. 3 are designated by the same reference numerals as the corresponding parts in FIG. 3, respectively.

In the third embodiment, as compared with the second embodiment, the sample/hold circuits 220, 230, the comparator circuits 240, 250, and the control circuit 260 are different in configuration.

The sample/hold circuit 220 includes a P-type TFT 222 and a capacitor 226, while the sample/hold circuit 230 includes a N-type TFT 232 and a capacitor 236. The comparator circuit 240 includes inverters 241, 242, capacitors 226, 243, and P-type TFTs 244, 245, 247, while the comparator circuit 250 includes inverters 251, 252, capacitors 236, 253, and N-type TFTs 254, 255, 257. The control circuit 260 includes a NOR gate 264.

In the inverters 241, 242 of the comparator circuit 240, the input and output are connected by the P-type TFTs 244, 245 for odd lines when the polarity control signal FLP1 is "H"

and the inverted version FLP2 thereof is "L". Under this condition, the input and output voltages of each inverter are biased to about one half of the source voltage, so that the charge corresponding to the bias voltage of each inverter is stored in the capacitor 243. Under this condition, the output PH(i) of the shift register SR(i) is inverted by the NAND gate 212 thereby to control the P-type TFT 222 and the positive video signal VID1 is sampled in the capacitor 226. Then, the P-type TFTS 244, 245 turn off and the P-type TFT 247 turns on for even lines when the polarity control signal FLP1 is "L" and the inverted version FLP2 thereof is "H". In the process, the inverters 241, 242 operate as an inversion amplifier based on one half of the source voltage, so that when the voltage of the signal line output VD(i) is equal to the voltage sampled by the sample/hold circuit 220, the output voltage of the inverter 242 becomes substantially equal to the bias voltage one half of the source voltage. When the voltage of the signal line output VD(i) is lower than the voltage sampled by the sample/hold circuit 220, on the other hand, the output voltage of the inverter 242 turns "L", while when the voltage of the signal line output VD(i) is higher than the sampled voltage, the output voltage of the inverter 242 turns "H". As a result of this operation, the voltage obtained by sampling the positive video signal VID1 is compared with the voltage of the signal line output VD(i).

The comparator circuit 250 and the sample/hold circuit 230 operate on the same principle as the corresponding component parts described above, except that the input and output of the inverters 251, 252 of the comparator circuit 250 are connected by the N-type TFTs 254, 255 for even lines when the polarity control signal FLP1 is "L" and the inverted version FLP2 thereof is "H". Under this condition, the input and output voltages of each inverter are biased to about one half of the source voltage and the charge corresponding to the bias voltage of each inverter is stored in the capacitor 253. Under this condition, the N-type TFT 232 is controlled by the output PH(i) of the shift register SR(i) through the AND gate 214, and the negative video signal VID2 is thereby sampled in the capacitor 236. Then, the N-type TFTs 254, 255 turn off and the N-type TFT 257 turns on for odd lines when the polarity control signal FLP1 turns "H" and the inverted version FLP2 thereof turns "L". In the process, the inverters 241, 242 operate as an inverting amplifier based on one half of the source voltage, and when the output voltage VD(i) of the signal line is equal to the voltage sampled by the sample/hold circuit 230, the output voltage of the inverter 252 becomes equal to the bias voltage about one half of the source voltage. When the output voltage VD(i) of the signal line is lower than the sample voltage, on the other hand, the output voltage of the inverter 252 turns "L", and vice versa. As a result of the foregoing operation, the voltage obtained by sampling the negative video signal VID2 is compared with the output voltage VD(i) of the signal line.

The OR gate 264 of the control circuit 260 is supplied with the output of the comparator circuit 240 and the polarity control signal FLP1 for controlling the P-type TFT 282 of the switch 280. With this configuration, the output turns "L" to turn on the P-type TFT only in the case where the output of the comparator circuit 240 is "L" for even lines when the polarity control signal FLP1 is "L". In the comparator circuit 240, the P-type TFT turns on in the case where the output voltage VD(i) of the signal line is higher than the voltage sampled by the sample/hold circuit 220.

As described above, the operation of each block is the same as that of the first embodiment shown in FIG. 1. The third embodiment of the invention, therefore, has the same effect as the first embodiment. Further, in view of the fact that the comparator circuit according to the third embodiment is configured with an inverter, a complicated bias circuit is not required and the voltage range to be compared is widened as compared with the comparator circuit using a differential circuit.

Figure 13:
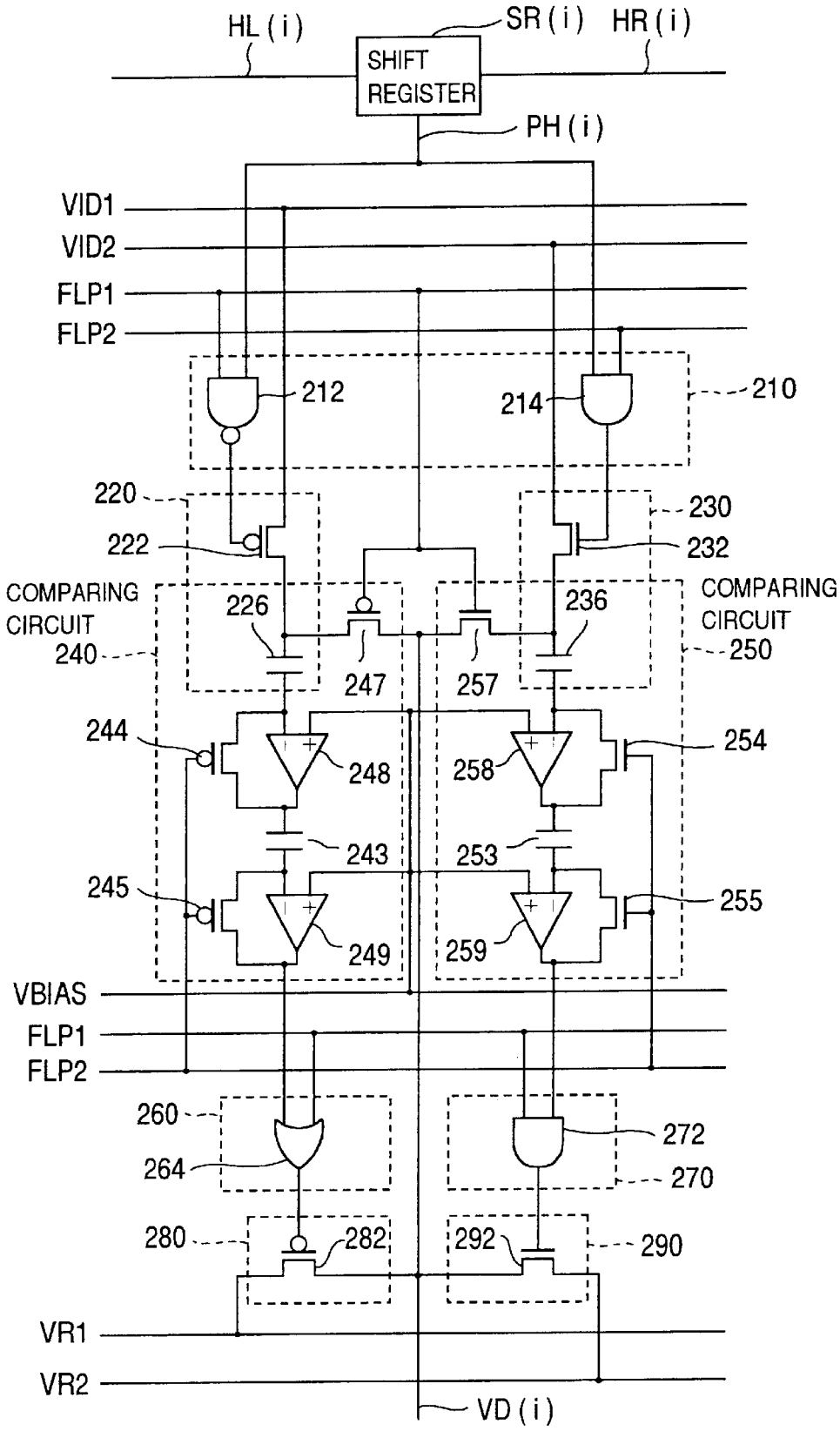
FIG. 13 is a block diagram showing a drive circuit used for a liquid crystal display panel according to a fourth embodiment of the invention.

FIG. 13 shows a drive circuit used for the liquid crystal display panel according to a fourth embodiment of the invention. In FIG. 13, the component parts identical to those included in the third embodiment shown in FIG. 4 are designated by the same reference numerals, respectively, as the corresponding parts in FIG. 4.

The drive circuit according to the fourth embodiment shown in FIG. 13, as compared with the third embodiment, has a different configuration of the comparators 240, 250. Specifically, the inverters 241, 242, 251, 252 used in the comparator circuit according to the third embodiment are replaced by differential amplifiers 248, 249, 258, 259 in this embodiment.

The differential amplifiers 248, 249, 258, 259 each have a positive input terminal, a negative input terminal and an output terminal. The positive input terminals of these differential amplifiers are connected to a common bias voltage VBIAS. The input and output of the inverters 241, 242, 251, 252 are connected in such a manner as to correspond to the negative input terminals and the output terminals, respectively, of the differential amplifiers.

The bias voltage VBIAS is preferably set to about one half of the source voltage. In this way, the relation between the negative input terminals and the outputs of the differential amplifiers 248, 249, 258, 259 can be equalized to the relation between the input and output of the inverters 241, 242, 251, 252, respectively. As a result, the drive circuit used for the liquid crystal display panel according to the fourth embodiment of the invention operates the same way as that of the third embodiment and has the same effect as the first embodiment.

Further, the source current of the inverter used in the third embodiment changes with the input voltage level. In the differential amplifier used for the drive circuit according to the fourth embodiment, in contrast, a constant source current having a fixed value independent of the input level can be secured using the bias of the differential amplifier stage as a constant current source. As a result, even in the case where the drive circuits of a plurality of drain lines operate at the same time, a constant source current is secured, and the noise transmitted through the power line is reduced, thereby making it possible to realize a liquid crystal display apparatus of large size.

The liquid crystal display apparatus according to embodiments of the invention will be explained below.

Figure 5:
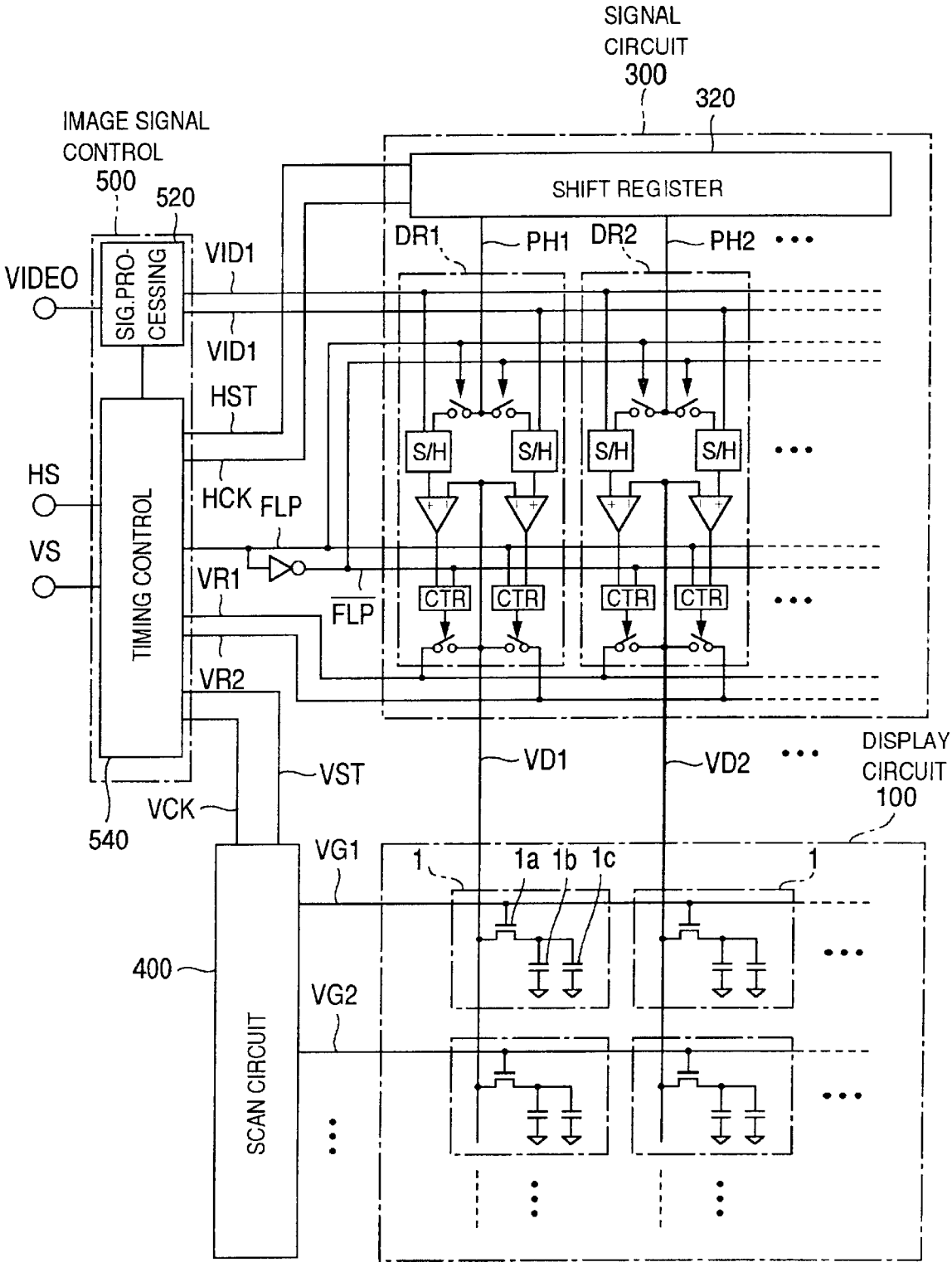
FIG. 5 is a block diagram showing a configuration of a liquid crystal display apparatus according to the first embodiment of the invention.

FIG. 5 is a block diagram showing a configuration of a liquid crystal display apparatus according to a first embodiment of the invention.

A liquid crystal display apparatus according to this invention comprises a display circuit 100, a signal circuit 300, a scanning circuit 400 and an image signal control circuit 500. The display circuit 100 is for applying to the liquid crystal a voltage corresponding to the image to be displayed, and includes pixel circuits 1 arranged in matrix. The pixel circuits 1 each include a N-type TFT 1*a*, a holding capacitor 1*b* and a liquid crystal capacitor 1*c*. The gate terminal of the N-type TFT 1*a* is connected to the scanning line, the drain terminal thereof is connected to the signal line, and the source terminal thereof is connected to the liquid crystal capacitor 1*c* and the holding capacitor 1*b*. The other end each of the holding capacitor 1*b* and the liquid crystal capacitor 1*c* is connected to the same potential as the electrode of the opposite substrate arranged in opposed relation to the display circuit 100 for holding the liquid crystal. The signal circuit 300 generates a voltage supplied to the signal line of the pixel circuits 1, and includes a shift register 320, drive circuits DR1, DR2 and so on. The drive circuits DR1, DR2 and so on correspond to the drive circuits shown in FIGS. 1, 3 and 4. The image signal control circuit 500 generates video signals VID1, VID2 supplied to the signal circuit 300, and a control signal supplied to the signal circuit 300 and the scanning circuit 400. The image signal control circuit 500 thus includes a signal processing circuit 520 and a timing control circuit 540. The signal processing circuit 520 outputs the video signals VID1, VID2 obtained by amplifying and converting the video signal VIDOE to the AC current. The timing control circuit 540 is supplied with horizontal and vertical sync signals Hs, Vs for generating a control signal for driving the shift register 320, the drive circuits DR1, DR2 and so on, and the scanning circuit 400.

Figure 6:
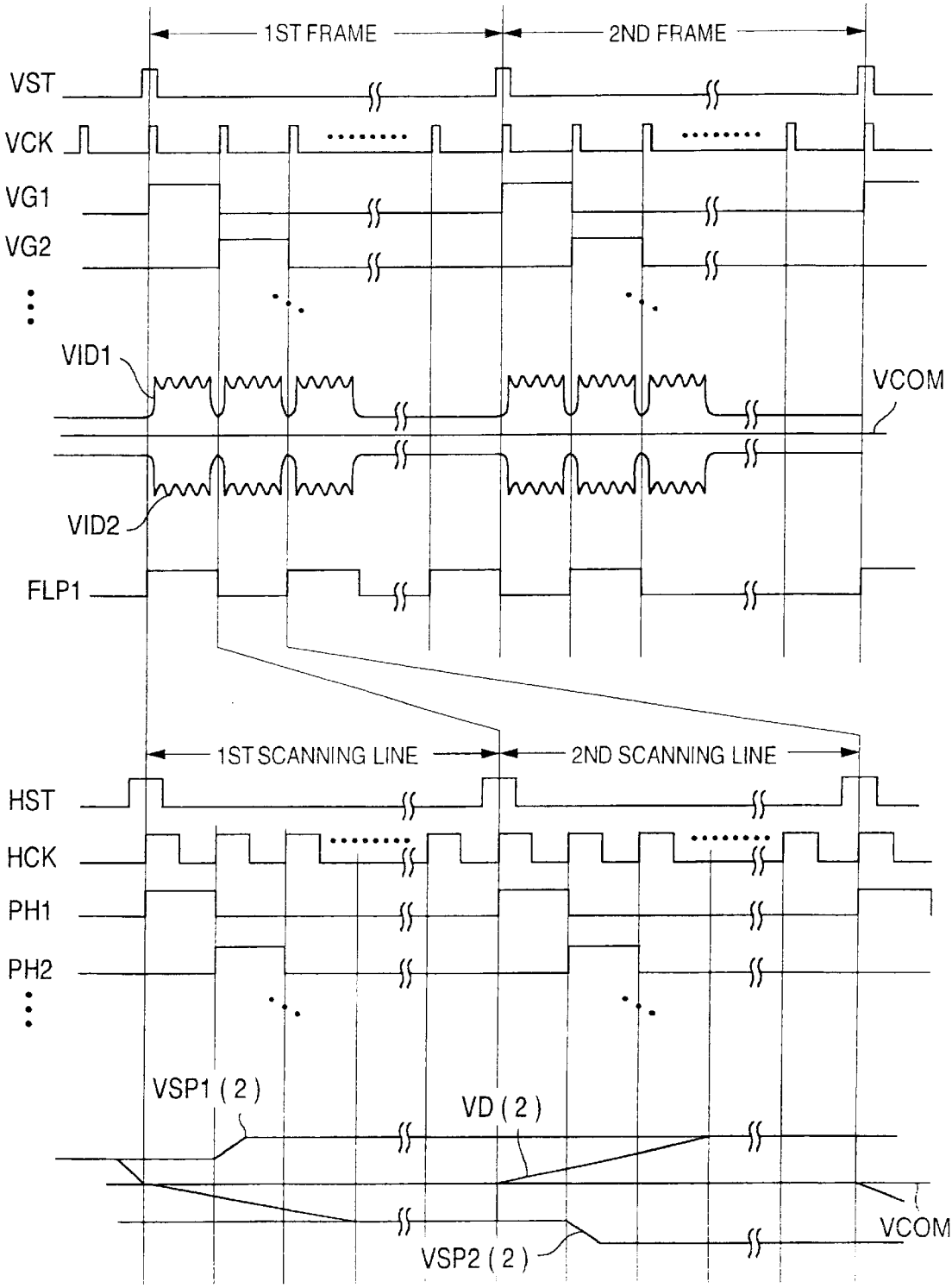
FIG. 6 is a timing chart showing the operation of a liquid crystal display apparatus according to an embodiment of the invention.

The operation of this embodiment of the invention configured as described above will be explained with reference to the timing chart of FIG. 6. A start signal VST and a clock signal VCK are control signals applied to the scanning circuit 400. The start signal VST indicates the head of the frame of the image displayed, and the clock signal VCK indicates the timing of switching the scanning lines. The signal circuit 300 fetches the start signal HST at the rise timing of the clock signal VCK, and outputs the signals VG1, VG2 and so on for the scanning lines.

The video signals VID1, VID2 are positive and negative, respectively, with respect to the voltage VCOM of the opposite electrode and are generated by the signal processing circuit 520. The polarity control signal FLP1 is inverted at the period of the clock signal VCK, and further inverted at the period of the frame of the start signal.

The start signal HST and the clock signal HCK are control signals input to the shift register 320. The start signal HST indicates the head of the pixel to be displayed, and the clock signal HCK indicates the scan timing corresponding to the pixel. The shift register 320 fetches the start signal HST at the rise timing of the clock signal HCK, and outputs the control signals PH1, PH2 and so on of the drive circuits DR1, DR2 and so on.

In response to a signal input thereto, each of the drive circuits DR1, DR2 and so on operates in the manner described in FIG. 1. Now, an explanation will be given briefly taking the second signal line VD2 as an example.

The signal VSP1 (2) is the positive video signal VID1 sampled by the control signal PH2, and the signal VSP2 (2) is the negative video signal VID2 sampled by the control signal PH2. VD2 designates a voltage of the second signal line. As shown in the timing chart of FIG. 2, the positive or negative ramp voltage assumes a constant value at a point where it crosses the signal VSP1 (2) or VSP2 (2). The pixel circuits 1 drive the liquid crystal by charging the voltage on the signal line into the holding capacitor.

According to this embodiment, the drive circuit is used as the signal circuit of the liquid crystal display apparatus thereby making it possible to realize a liquid crystal display apparatus with built-in circuits having a small area occupied by the drive circuit.

Figure 7:
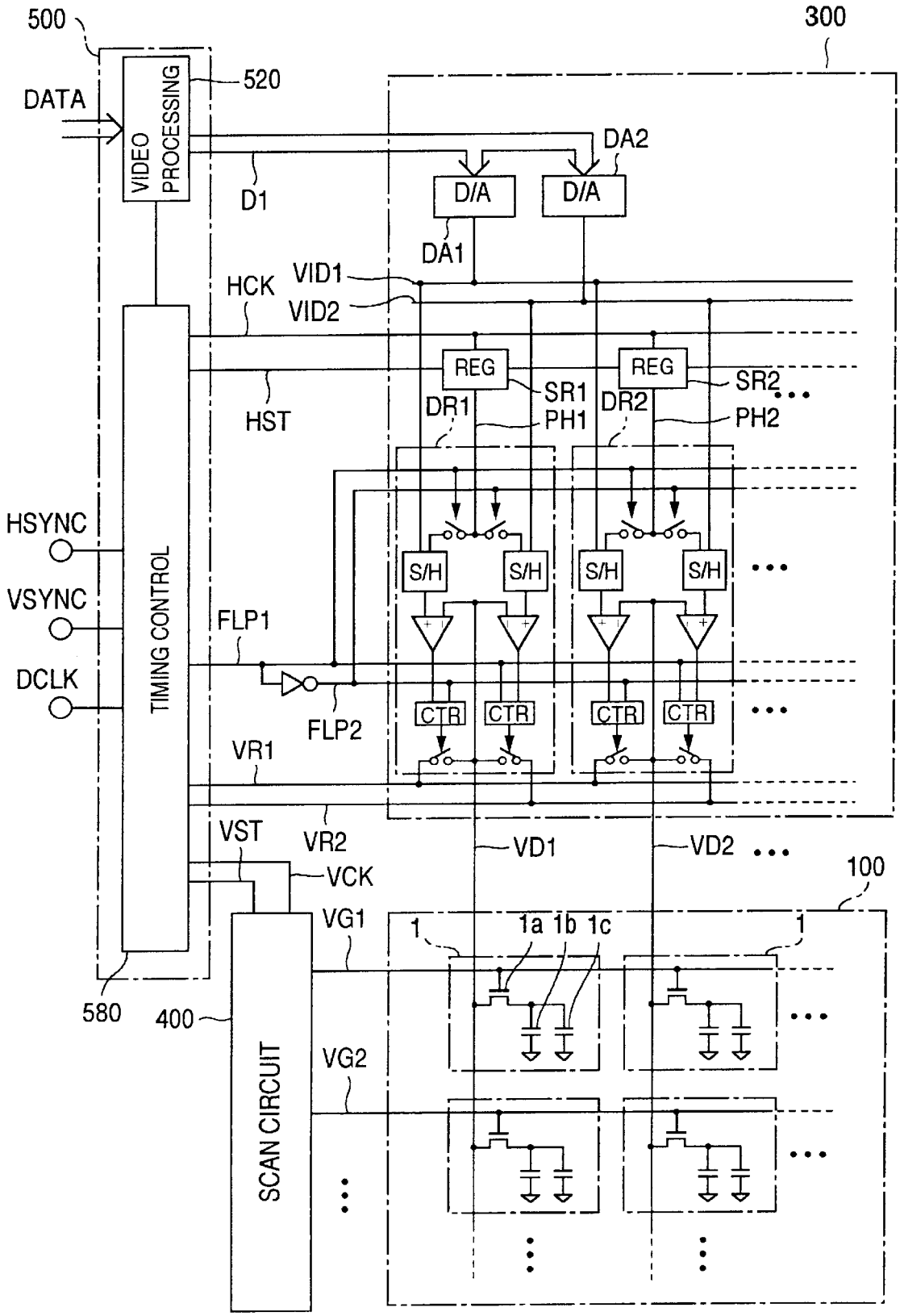
FIG. 7 is a block diagram showing a configuration of a liquid crystal display apparatus according to a second embodiment of the invention.

FIG. 7 is a block diagram showing a liquid crystal display apparatus according to a second embodiment of the invention. The functions of the liquid crystal display apparatus according to the invention shown in FIG. 5 which are similar to those of the component parts of the first embodiment are designated by the same reference numerals, respectively, as the corresponding functions of the first embodiment.

The liquid crystal display apparatus according to this embodiment shown in FIG. 5 is different from the first embodiment in the configuration of the signal circuit 300 and the image signal control circuit 500. The signal circuit 300 includes digital-to-analog (D/A) converters DA1, DA2, video signal lines VID1, VID2, shift registers SR1, SR2 and so on, and drive circuits DR1, DR2 and so on. The image signal control circuit 500 is configured with a video signal processing circuit 560 and a timing control circuit 580. The video signal processing circuit 560 is supplied with a digital video signal DATA and outputs a digital video signal Dl of the D/A converters in the signal circuit. The timing control circuit 580, on the other hand, is supplied with a clock signal DCLK, a horizontal sync signal HSYNC and a vertical sync signal VSYNC and outputs a signal for driving the shift registers SR1, SR2 and so on, the drive circuits DR1, DR2 and so on, and the scanning circuit 400.

The D/A converter DA1 of the signal circuit 300 is for converting a digital video signal into a positive video signal, and the D/A converter DA2 is for converting a digital video signal into a negative video signal.

According to this embodiment, the operation is performed by inputting a digital video signal, and therefore the video signal circuit can be configured as a simple circuit.

Figure 8:
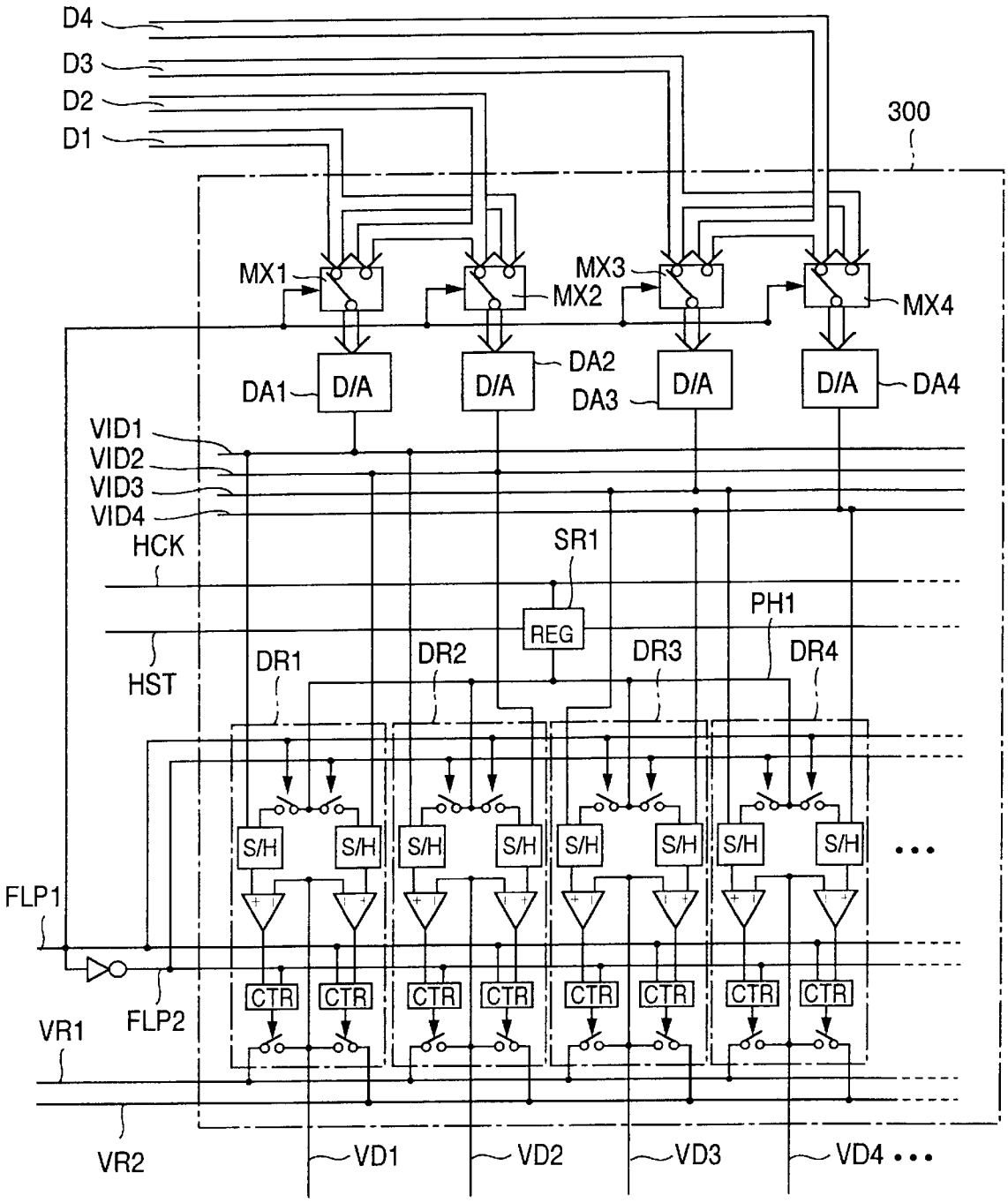
FIG. 8 is a block diagram showing a configuration of a liquid crystal display apparatus according to a third embodiment of the invention.

FIG. 8 is a block diagram showing a liquid crystal display apparatus according to a third embodiment of the invention. The liquid crystal display apparatus according to this embodiment shown in FIG. 7 is different from the second embodiment in the signal circuit 300 specifically shown.

The signal circuit 300 includes digital signal switching circuits MX1 to MX4, D/A converters DA1 to DA4, video signal lines VID1 to VID4, a shift register SR1, and drive circuits DR1, DR2 and so on. The D/A converters DA1, DA3 are for producing a positive video signal, and the D/A converters DA2, DA4 are for producing a negative video signal.

The digital video signals D1 to D4 input to the signal circuit 300 are serially-input video signals converted into parallel video signals representing data adjacent to each other. The video signals D1 to D4 are input through the switching circuits MX1 to MX4 to the D/A converters DA1 to DA4. The switching circuits MX1 to MX4 are controlled by the polarity control signal FLP1 for switching the inputs of the D/A converters DA1, DA2 into the video signals D1, D2 or the video signals D2, D1, respectively, and the inputs of the D/A converters DA3, DA4 into the video signals D3, D4 or the video signals D4, D3, respectively. The D/A converters DA1 to DA4 each are supplied with the data described above and output the converted analog signals to the video signal lines VID1 to VID4. As a result of this operation, the signals on the video signal lines VID1 to VID4 correspond to the video signals D1, D2, D3, D4, respectively, when the polarity switching signal FLP1 is "H", and correspond to the video signals D2, D1, D4, D3, respectively, when the polarity switching signal FLP1 is "L". The drive circuits DR1, DR2 and so on are each supplied with positive and negative video signals from the video signal line and switch them by the polarity control signal FLP1. Specifically, the positive signal on the video signal line VID1 and the negative video signal on the video signal line VID2 are input to the drive circuits DR1, DR2, while the positive video signal on the video signal line VID3 and the negative video signal on the video signal line VID4 are input to the drive circuits DR3, DR4, respectively. The positive and negative video signals thus input are switched by the polarity control signal. For the purpose of this switching operation, the drive circuits DR1, DR2 or the drive circuits DR3, DR4 are connected in opposite polarities. According to this embodiment, when the polarity switching signal FLP1 is "H", the drive circuits DR1 to DR4 sample the signals on the video signal lines VID1, VID2, VID3, VID4 in that order, while when the polarity switching signal FLP1 is "L", on the other hand, the signals on the video signal lines VID2, VID1, VID4, VID3 are sampled in that order. The shift registers SR1 and so on are each arranged for each set of four signal lines, and output a signal changing in accordance with the video signals D1 to D4.

As a result of the operation described above, the drive circuits DR1 to DR4 sample the video signals D1 to D4 converted into analog signals. Then, the polarity of the video signals is positive, negative, positive and negative, in that order when the polarity switching signal FLP1 is "H", while it is negative, positive, negative and positive in that order when the polarity switching signal FLP1 is "L".

According to this embodiment, the positive and negative D/A converters can be switched for operation, and therefore the area occupied by the D/A converters can be reduced to one half.

Figure 9:
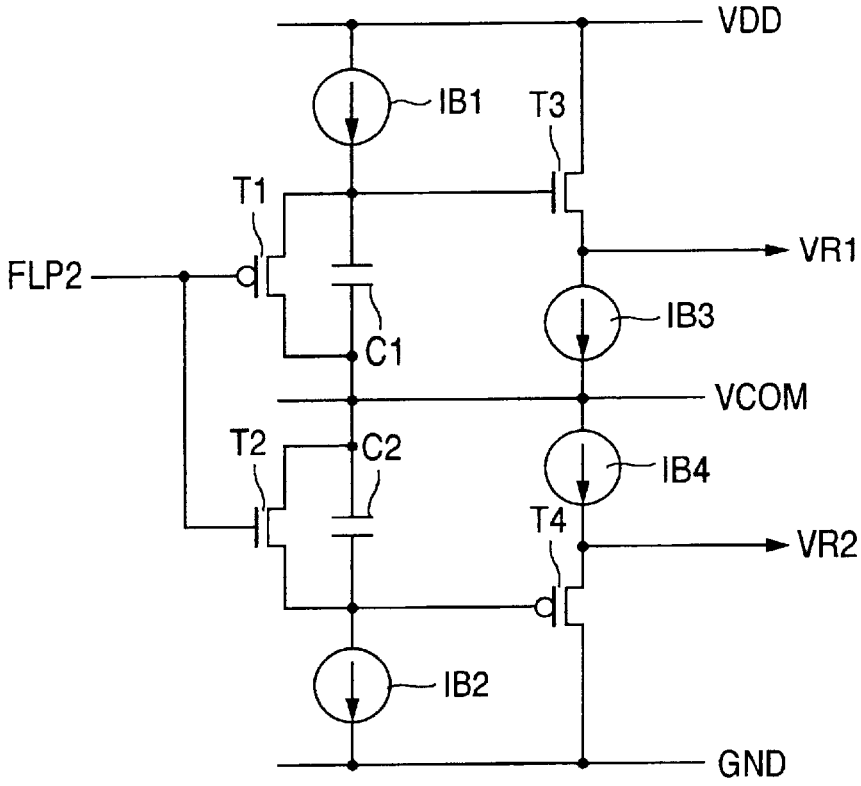
FIG. 9 is a diagram showing a circuit configuration of a voltage generating circuit used for a liquid crystal display panel drive circuit according to an embodiment of the invention.

FIG. 9 shows an output control power circuit used for the liquid crystal display panel drive circuit according to an embodiment of the invention.

This embodiment is configured with power supplies IB1 to IB4, capacitors C1, C2, P-type TFTs T1, T4, and N-type TFTs T2, T3. The current of the current source IB1 is integrated by the capacitor C1 to generate a positive ramp voltage, while the current of the current source IB2 is integrated by the capacitor C2 to generate a negative ramp voltage. The ramp voltage thus generated is output as output control voltages VR1, VR2, respectively, through a source-follower circuit including a current source IB3 and a N-type TFT T3 or a source-follower circuit including a current source IB4 and a P-type TFT T4. Also, each ramp voltage is initialized by the N-type TFT T1 and the P-type TFT T2. Each TFT is supplied with the inverted version FLP2 of the polarity control signal.

Figure 10:
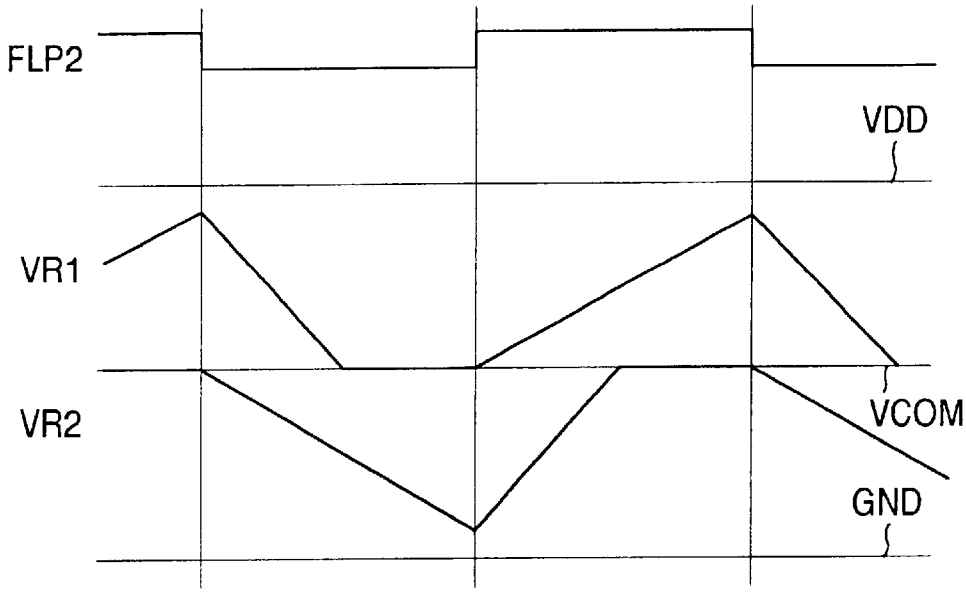
FIG. 10 is a timing chart showing the operation of a voltage generating circuit used for a liquid crystal display panel drive circuit according to the invention.

The operation of the embodiment having the configuration described above will be explained with reference to the timing chart of FIG. 10. When the inverted version FLP2 of the polarity control signal is "L", the P-type TFT T1 turns on while the N-type TFT T2 turns off. As a result, the positive ramp voltage is initialized and the negative ramp voltage starts declining. As long as the inverted version FLP2 of the polarity control signal remains "H", on the other hand, the P-type TFT T1 turns on and the N-type TFT T2 turns off. As a result, the positive ramp voltage starts increasing and the negative ramp voltage is initialized.

Figure 11:
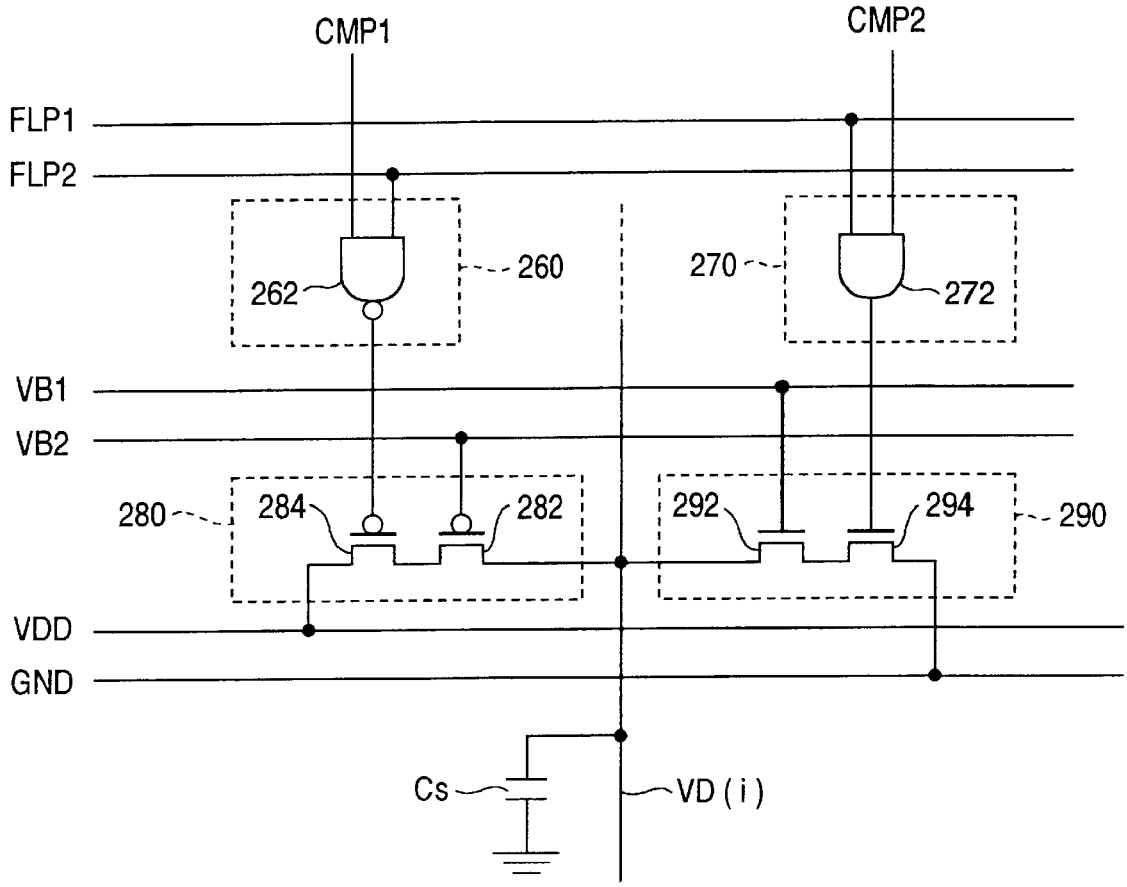
FIG. 11 is a diagram showing a circuit configuration of the output circuit used for a liquid crystal display panel drive circuit according to another embodiment of the invention.

FIG. 11 is a diagram showing a circuit configuration of the output unit of the liquid crystal display panel drive circuit according to an embodiment of the invention. This embodiment is different from the embodiment shown in FIG. 3 in the configuration of the switches 280, 290. The switch 280 is configured with P-type TFTs 282, 284, and the switch 290 is configured with N-type TFTs 292, 294. The P-type TFTs 282, 284 have the drain and the source thereof connected in series between the signal line VD(i) and the power supply VDD, while the N-type TFTs 292, 294 have the drain and the source thereof connected in series between the signal line VD(i) and the ground GND. The gates of the P-type TFTs 282, 284 are connected with the outputs of the bias power supply VVB2 and the control circuit 260, respectively, while the gates of the N-type TFTs 292, 294 are connected with the outputs of the bias power supply VB1 and the control circuit 270, respectively. The P-type TFT 282 and the N-type TFT 292 operate as a constant current source. When the switch 280 or 290 is in on state, therefore, the parasitic capacitor Cs of the signal line VD(i) is charged by the current due to the P-type TFT 282 or the N-type TFT 292. Thus, the voltage of the signal line assumes the same waveform as in the embodiment shown in FIG. 3.

According to this embodiment, the output drive power may be a constant voltage, and therefore the control circuit is simplified. Also, no circuit is required for generating the ramp voltage.

Figure 12:
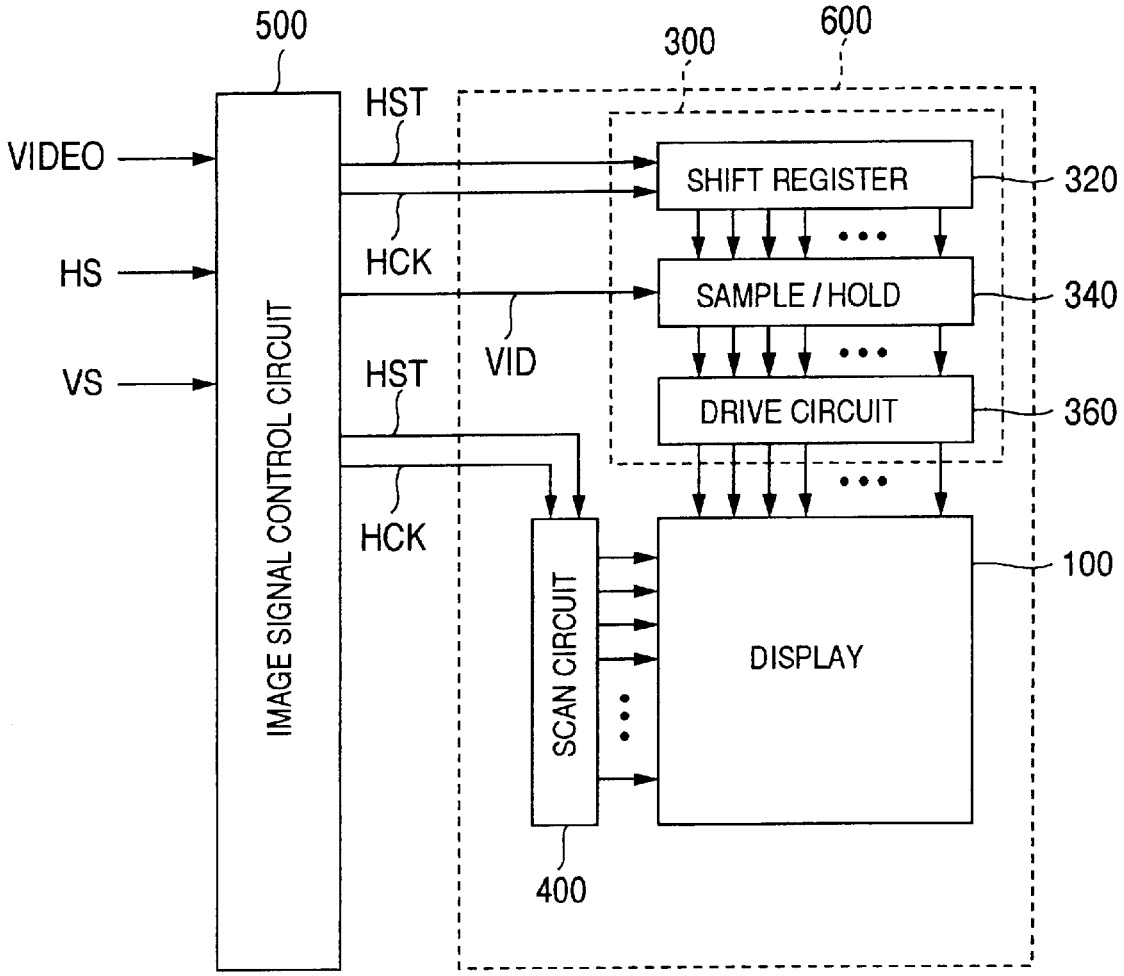
FIG. 12 is a block diagram showing a general configuration of a liquid crystal apparatus according to the invention.

FIG. 12 is a block diagram showing a general configuration of the liquid crystal display apparatus according to this invention.

This block diagram represents a configuration including a liquid crystal display panel 600 integrated with the drive circuit and an image signal control circuit 500. The liquid crystal display panel 600 integrated with drive circuit includes a display circuit 100, a signal circuit 300 and a scanning circuit 400, while the display circuit 100 includes a shift register 320, a sample/hold circuit 340 and a drive circuit 360. According to this embodiment, the signal circuit 300 and the scanning circuit 400 are formed on the same substrate as the display circuit 100.

It will thus be understood from the foregoing description that in the liquid crystal display panel drive circuit according to this invention, the signal lines are controlled by switches, and therefore the area occupied by the drive circuits can be reduced. Further, the use of this drive circuit can realize a large-sized liquid crystal display apparatus integrated with a drive circuit.

What is claimed is:

1. A liquid crystal display apparatus comprising:

a plurality of switching elements arranged at intersections between a scanning line and a signal line;

a scanning circuit for controlling a voltage of the scanning line;

a first substrate having formed thereon a signal circuit for controlling a voltage of the signal line;

a second substrate having a transparent electrode formed on one side thereof;

a liquid crystal held between the first substrate and the second substrate;

a first D/A converter which converts a digital video signal into a positive analog voltage;

a second D/A converter which converts a digital Video signal into a negative analog voltage;

a first drive circuit for driving the signal line by sampling the positive analog signal at a predetermined timing; and a second drive circuit supplied with a negative analog voltage for driving the signal line by sampling the negative analog voltage, wherein the first drive circuit comprises:

a first sample/hold circuit for sampling the positive analog signal, a first comparator circuit for comparing an output of the first sample/hold circuit with the voltage of the signal line, a first switch for controlling the output voltage of the signal line, first voltage supply means for supplying a voltage to the first switch, and a first control circuit for controlling the first switch in accordance with an output of the first comparator circuit; and wherein the second drive circuit comprises:

a second sample/hold circuit for sampling the negative analog voltage, a second comparator circuit for comparing an output of the second sample/hold circuit with the voltage of the signal line, a second switch for controlling the output voltage of the signal line, a second voltage supply means for supplying a voltage to the second switch, and a second control circuit for controlling the second switch in accordance with an output of the second comparator circuit.

2. A liquid crystal display apparatus according to claim 1, wherein the first sample/hold circuit and the second sample/hold circuit are connected in parallel with respect to the signal line.

3. A liquid crystal display apparatus comprising:

a plurality of switching elements each arranged at an intersection between a scanning line and a signal line;

a scanning circuit for controlling a voltage of the scanning line;

a first substrate having formed thereon a signal circuit for controlling a voltage of the signal line;

a second substrate having a transparent electrode formed on one side thereof;

a liquid crystal held between the first substrate and the second substrate;

first and second latch circuits for holding a successive values of a digital video signal;

switching means for switching outputs of the latch circuits to each other;

a first D/A converter connected to one of the outputs of the switching means for converting a digital video signal into a positive analog voltage;

a second D/A converter connected to the other output of the switching means for converting a digital video signal into a negative analog voltage;

first and second analog signal bus lines connected to the first and second D/A converters, respectively; and first and second output means connected to the first and second bus lines, respectively, for driving the first and second signal lines;

wherein the first and second output means each include a first drive circuit connected to the first bus line for controlling a positive voltage, and a second drive circuit connected to the second bus line for controlling a negative voltage;

wherein the output of the first latch circuit is applied through the first D/A converter to the first drive circuit constituting the first output means thereby to drive the first signal line, and the output of the second latch circuit is applied through the second D/A converter to the second drive circuit constituting the second output means thereby to drive the second signal line; and wherein the output of the first latch circuit is applied through the second D/A converter to the second drive circuit constituting the first output means thereby to drive the first signal line, and the output of the second latch circuit is applied through the first D/A converter to the first drive circuit constituting the second output means thereby to drive the second signal line.

4. A liquid crystal display apparatus according to claim 3, wherein the first drive circuit includes a first sample/hold circuit;

wherein the second drive circuit includes a second sample/hold circuit; and wherein the first sample/hold circuit and the second sample/hold circuit are connected in parallel with respect to the relevant signal line.

* * * * *

UNITED STATES PATENT AND TRADEMARK OFFICE

CERTIFICATE OF CORRECTION

PATENT NO. : 6,628,261 B2
DATED : December 7, 2004
INVENTOR(S) : Soelch et al.

It is certified that error appears in the above-identified patent and that said Letters Patent is hereby corrected as shown below:

Column 15,
Line 11, after the word "least", delete "50° C" and insert therefor -- 5° C --.

Signed and Sealed this

Twenty-fifth Day of January, 2005

JON W. DUDAS
*Director of the United States Patent and Trademark Office*

UNITED STATES PATENT AND TRADEMARK OFFICE

CERTIFICATE OF CORRECTION

PATENT NO. : 6,628,261 B1
DATED : September 30, 2003
INVENTOR(S) : Hideo Sato et al.

It is certified that error appears in the above-identified patent and that said Letters Patent is hereby corrected as shown below:

This certificate supersedes certificate of correction issued January 25, 2005, the number was erroneously mentioned and should be vacated since no certificate of correction was granted.

Signed and Sealed this

Fourteenth Day of June, 2005

JON W. DUDAS
*Director of the United States Patent and Trademark Office*